US005489462A

United States Patent [19]

Sieber

[11] Patent Number: 5,489,462

[45] Date of Patent: Feb. 6, 1996

[54] DISTANCE PLATE BUILDING COMPONENT WITH A PROTECTIVE, VENTILATING, HEAT-INSULATING AND DRAINAGE FUNCTION

[76] Inventor: Werner Sieber, Sonnenstrase 21, CH-9448 Widnau, Switzerland

[21] Appl. No.: 230,791

[22] Filed: Apr. 21, 1994

Related U.S. Application Data

[63] Continuation-in-part of Ser. No. 975,565, Feb. 4, 1993, abandoned.

[51] Int. Cl.[6] ..... E02D 31/02

[52] U.S. Cl. ..... 428/174; 428/156; 428/163; 428/166; 428/167; 428/178; 428/179; 428/180; 428/181; 428/213; 428/99; 428/192; 52/58; 52/169.14; 52/302.1; 52/302.6; 52/220.1; 52/220.2; 52/386; 405/45; 405/38

[58] Field of Search ..... 428/156, 163, 428/166, 167, 174, 178, 179, 180, 181, 213, 99, 192; 52/58, 169.14, 302.1, 302.6, 220.1, 220.2, 381; 405/45, 38

[56] References Cited

U.S. PATENT DOCUMENTS

| | | | |
|---|---|---|---|
| 3,419,457 | 12/1968 | Bleasdale | 428/131 |
| 3,791,443 | 2/1974 | Burt et al. | 165/45 |
| 3,888,087 | 6/1975 | Bergsland | 61/11 |
| 4,574,541 | 3/1986 | Raidt et al. | 52/169.5 |
| 4,752,520 | 6/1988 | Franklin | 428/161 |
| 4,840,515 | 6/1989 | Freese | 405/45 |
| 4,907,386 | 3/1990 | Elsroth | 52/169.14 |
| 4,917,933 | 4/1990 | Schluter | 428/99 |
| 4,923,733 | 5/1990 | Herbst | 428/156 |
| 4,993,202 | 2/1991 | Thiel | 52/220 |
| 5,201,154 | 4/1993 | Thomas | 52/102 |

FOREIGN PATENT DOCUMENTS

| | | |
|---|---|---|
| 34828 | 9/1981 | European Pat. Off. . |
| 2329828 | 1/1975 | Germany . |

*Primary Examiner*—William P. Watkins, III
*Attorney, Agent, or Firm*—Laurence R. Brown

[57] ABSTRACT

A building component in the form of a board-like distance plate having a lattice of horizontal and vertical ribs. Frusto-pyramid projections (3) extend from the intersections of the ribs on one side of the board and domes (4) extend from the other side of the board between the ribs and cover a larger surface area than the projections (3). The domes form cavities which are interconnected by virtue of the projections spacing the plate from a wall or other surface.

4 Claims, 5 Drawing Sheets

FIG. 9
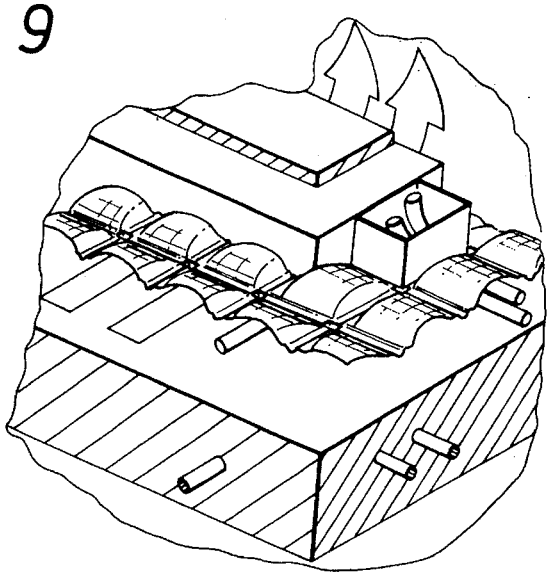
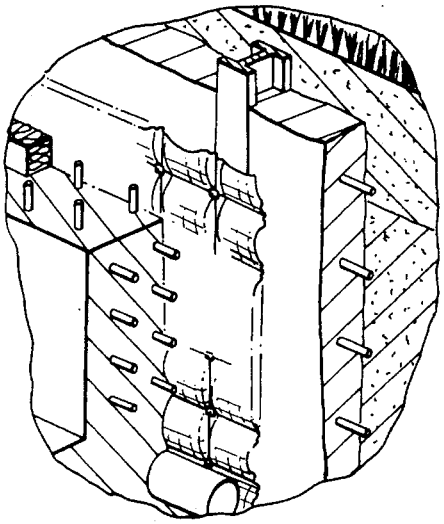
FIG. 10
FIG. 11
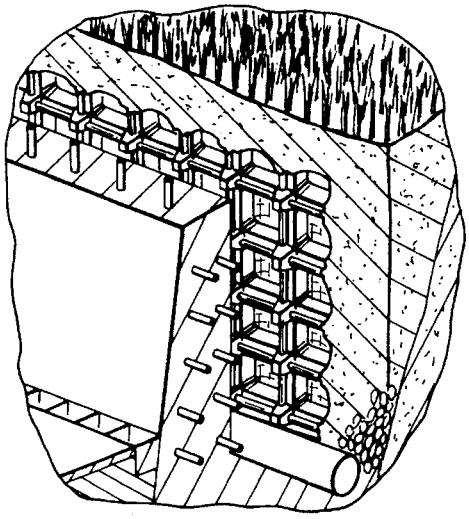

DISTANCE PLATE BUILDING COMPONENT WITH A PROTECTIVE, VENTILATING, HEAT-INSULATING AND DRAINAGE FUNCTION

This application is a continuation-in-part of parent application Ser. No. 07/975,565 filed Feb. 4, 1993 abn.

FIELD OF THE INVENTION

The present invention relates to a board-like building component with a protective, ventilating, heat-insulating and drainage function, with shaped regions serving as spaces.

BACKGROUND OF THE INVENTION

Such building components are used in construction and civil engineering and are arranged, in particular, in the region of the foundations between the building and the ground.

Known building components of the generic type usually consist of webs of a sheet-like plastics material, the sheets of plastics material having knobs which come to rest on the side of the building to be protected. Apart from the low static loadability of such film-like building components, the air space formed by the arrangement thereof is so small that any moisture which has penetrated barely evaporates again.

The object of the present invention is to provide a building component having an improved protective, ventilating, heat-insulating and drainage function.

SUMMARY OF THE INVENTION

According to the present invention there is provided a board-like building component in the form of a distance plate for use in building construction for the purposes of protection, ventilation, heat-insulation and drainage, the distance plate comprising a board of pressure-resistant material having a first plurality of parallel evenly-spaced rows of ribs and a second plurality of parallel evenly-spaced rows of ribs perpendicular to said first plurality to form a lattice, frusto-pyramid projections extending from one side of the board at the intersections of the ribs and domes with flattened outer surfaces extending from the other side of the board between the ribs and covering a larger surface area of the board than the projections, whereby when the flattened truncated ends of the pyramids are placed against the wall of a building the domes form cavities and the projections form spacers which cause said cavities to be inter-connected.

Owing to its particular design, this building component has a number of advantages. Owing to the size and shape of the cavities, the vapour is carried off perfectly into the open so that the wall of the building is dried and effective mould control is thus achieved.

The building component also has high static stability so, on the one hand, the protective action is improved and, on the other hand, the range of applications is increased. It may also be used in a horizontal position to form hollow floors for example for installation purposes. For example, the building component may also be used on a grassed roof where it can serve simultaneously for heat insulation, damp-proofing and for root protection; the external recesses also form a water reservoir for the plants.

This building component may also be compactly stacked to simplify storage.

The board-like building components may be laid simply and quickly. If the individual building components are bonded to one another, they act as a high quality vapour trap. The building components may be fastened quickly and reliably on a building, where required, without leaking at the fastening point.

BRIEF DESCRIPTION OF THE DRAWINGS

An embodiment of the subject of the invention is described in detail hereinafter with reference to the drawings.

FIGS. 7 to 11 show various uses of the building component.

DESCRIPTION OF PREFERRED EMBODIMENT

Figure 1:
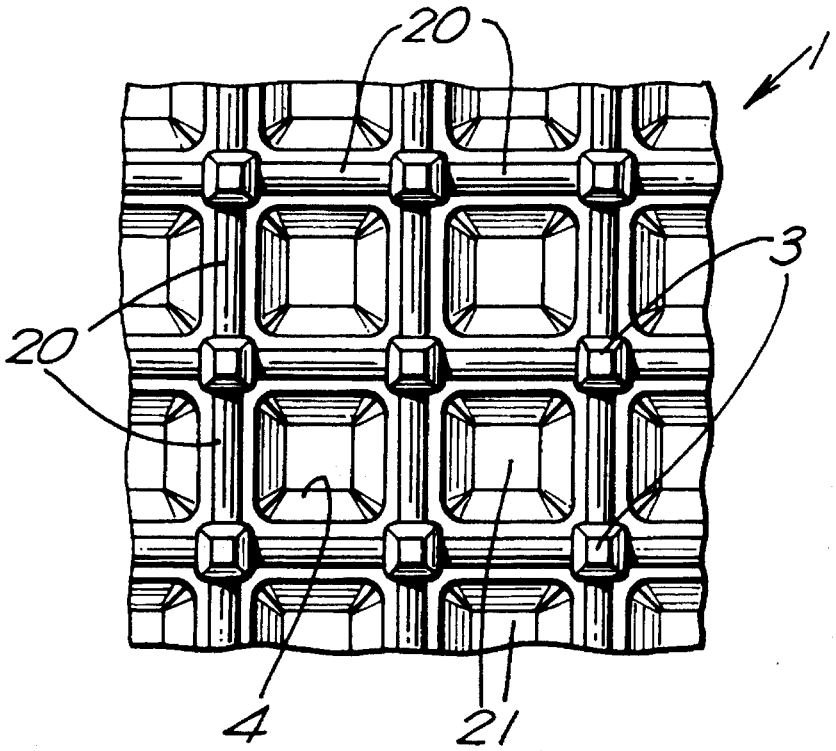
FIG. 1 is a partial perspective view of a building component in accordance with the invention.
Figure 2:
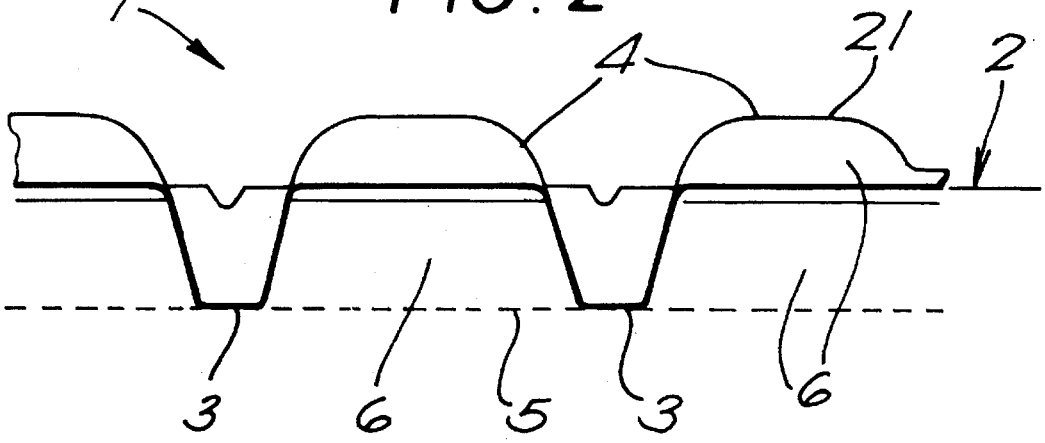
FIG. 2 is a side view of the same building component.

The board-like building component 1 in the form of a distance plate consists of pressure-resistant material, preferably a plastics material which is resistant to rotting and ageing. The component is formed as a lattice of horizontal and vertical ribs 20. It should be noted that horizontal and vertical merely refers to the orientation of the ribs in an upright vertical position of a board and that corresponding directions are intended when the board is lying flat or at another angle. At the intersections of the ribs on one side of the board there extend frusto-pyramid projections 3 from a centre plane 2. The flattened truncated ends of the pyramids are adapted to lie against a building or other surface. From the other side of the board between the ribs there extend from the centre plane 2 domes 4 having flattened outer surfaces 21.

The shaped projections 3 on the side of the board to be turned toward the building 5 demand a smaller respective area than the domes 4 on the side of the board to be turned away from the building 5 and act as spacers. The domes 4 on the side of the board to be turned away from the building 5 form cavities between the building 5 and the building component 1, which cavities 6 communicate with one another.

Figure 3:
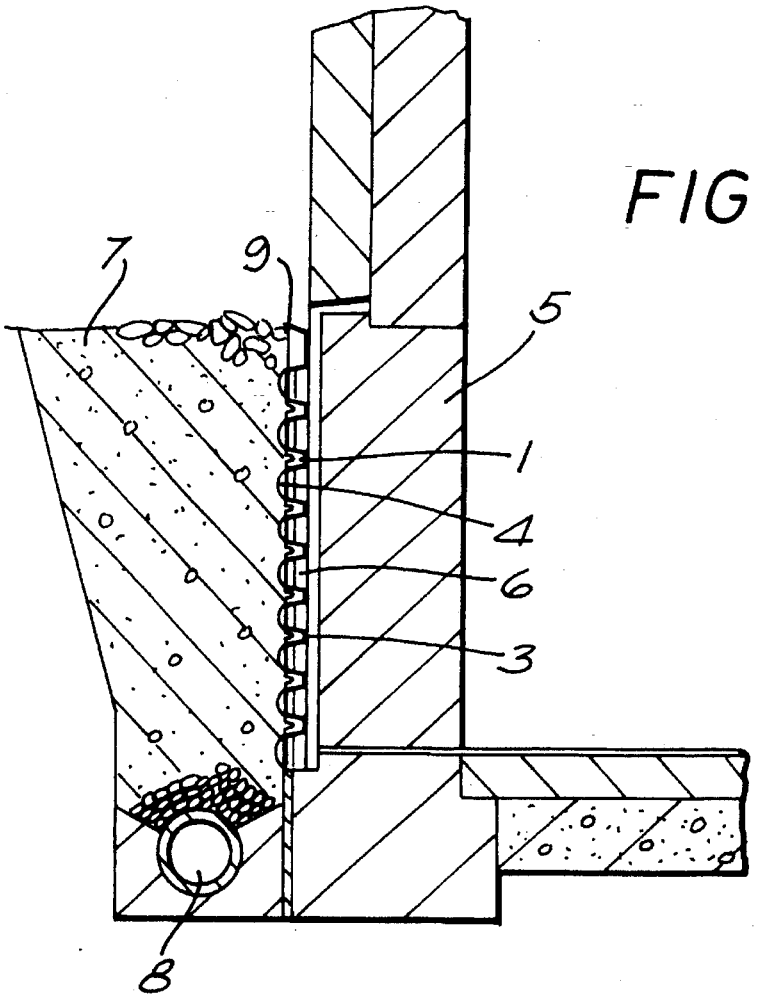
FIG. 3 shows an application of the component used in a building.
Figure 4:
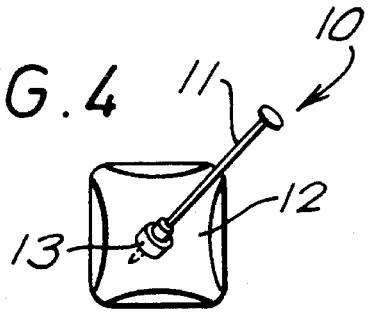
FIG. 4 is a view of a fastening device.
Figure 5:
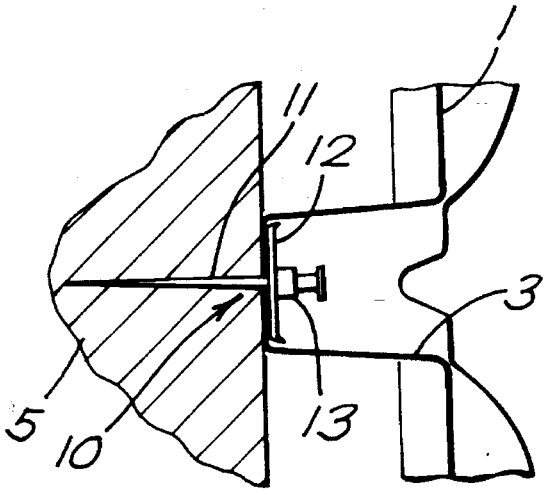
FIG. 5 shows how a building component according to FIG. 1 may be fastened on a building using the fastening device according to FIG. 4.
Figure 6:
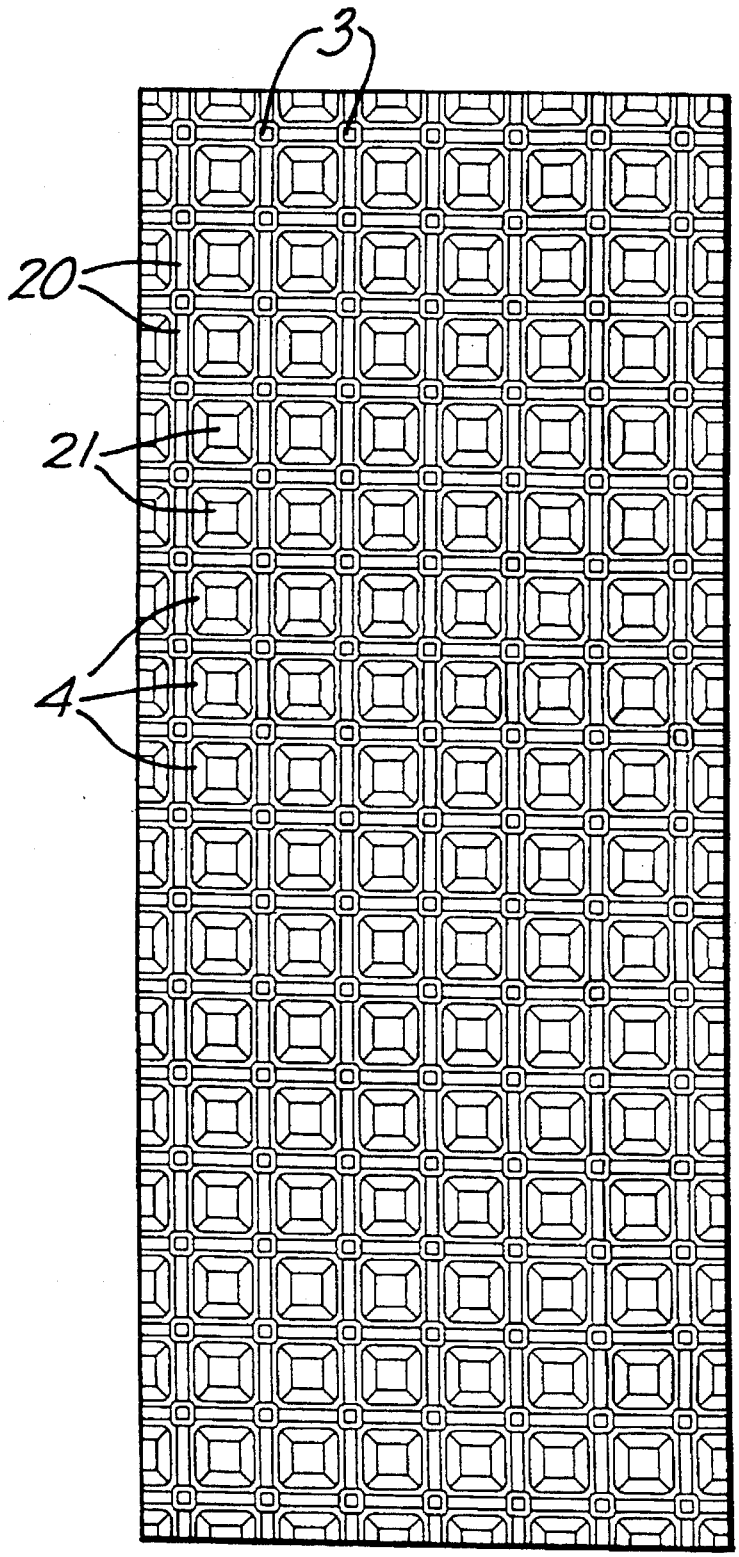
FIG. 6 shows a plan view of the building component.

FIG. 3 shows the use of the building component 1 on a foundation. In this case, the building component is arranged on the exterior of the building 5, between the walling and the backfill 7, where it protects the walling and allows ventilation and drying thereof. It forms an excellent seal against water penetration and against vapour penetration from the ground. The water is carried off externally to the drainage pipe 8 in a perfect manner.

It is also conceivable to use the heat in the air gap between wall and building component for heating purposes, with the aid of a heat pump.

It is also possible to use the ground heat at the exterior of the building component, whether by the formation of air channels in or on the building component 1 or by arrangement of pipes on the side of the building component remote from the building 5. For this purpose, the building component may be constructionally prepared for the fastening of the heat exchanger pipes by providing appropriate mountings.

A fan which either accelerates the drying of the wall or assists the after-flow of air when heat is used may be provided. For this purpose, the fan may either act upon the air gap between building component 1 and building 5 or be connected to the above-mentioned air channels in or on the building component 1.

Finally, closure means 9 may be provided for the selective closure or opening of the air gap between building component 1 and building 5. These may be flaps or sliders which are opened and closed manually or also automatically as a function of the temperature measured in the air gap or the external temperature. In particular, it is anticipated that the closure means 9 will be closed when the external temperature is lower than the temperature in the air gap.

In addition to the application just described, the building component 1 may optionally be used wherever a protective, ventilating, heat-insulating and drainage function is required and an air space is to be formed by the projections serving as spacers.

The device 10 for fastening the building component 1 has a fixing means 11 which is intended to pass through the building component 1 and penetrate the building 5. The fixing means 11 may be, for example, a nail or a screw and has a plate 12 which is to rest on the side of the building component 1 to be turned away from the building 5. The plate is shaped such that it fits from the exterior, i.e. from the side of the building component 1 remote from the building, into the respective projections 3 of the building component 1 manifested as recesses from this side. This plate 12 serves several purposes. On the one hand, it protects the building component 1 from mechanical damage when the fixing means 11 is driven through it into the building and, on the other hand, serves as a guide for the fixing means 11. For this purpose, the plate 12 has a hole which is provided with a reinforced sleeve-like border 13. The fixing means 11 is thus held substantially in the centre of the plate 12. Finally, the plate 12 ensures that leaks cannot occur at the fastening point.

The distance plate may be used for exterior walls in soil as described with reference to FIG. 3, in which function it assists in ventilation of exterior walls (with or without insulation), protects exterior walls in soil, has a filter function and ensures draining of water so as to prevent accumulation of water.

Figure 7:
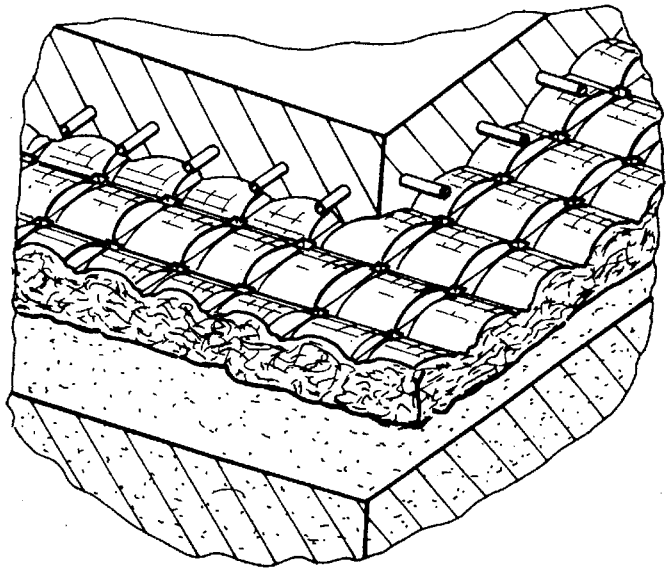
Figure 8:
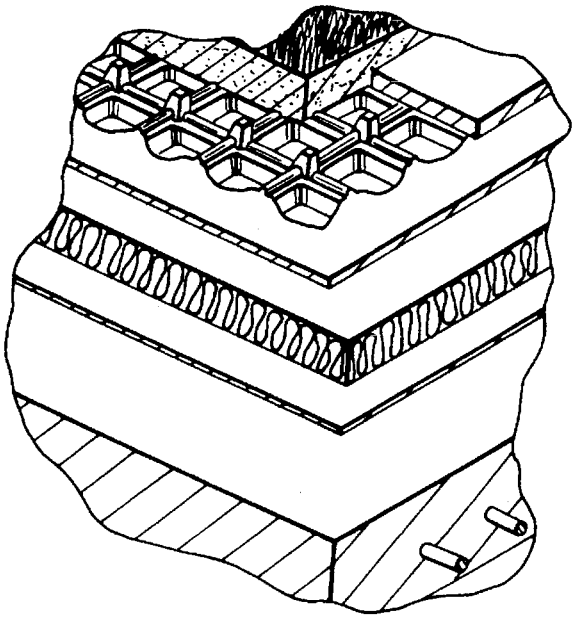

The distance plate may also be used as a sub-foundation plate as shown in FIG. 7, where it stabilizes foundation soil, supports reinforcements, protects against rising moisture and protects against ground radiation. As shown in FIG. 8 the distance plate may be used on roofs covered with sod so that it protects the waterproof coating of a roof, stores water for grass or plants, acts as a lightweight sub-base for the roof covering and may provide sub-ventilation for additional coverings. In FIG. 9 the distance plate is used for a sub-ventilated floor where it provides separation between sub-floor and concrete plate, provides efficient sub-ventilation with little loss of heat, protects against moisture for cellar floors and gives sufficient space for installations in the floor and easy mounting of distribution boxes. In front of interior walls and pile planking as shown in FIG. 10 the distance plate provides draining between interior and exterior building walls and prevents accumulation of mud. The high degree of resistance to pressure ensures constant distance between walls. Behind retaining walls as shown in FIG. 11 the distance plate provides draining and rear ventilation of walls and soil. It also prevents accumulation of mud and its high degree of resistance to pressure ensures constant spacing even in the case of strong soil pressure.

I claim:

1. A building component in the form of a distance plate for use in building construction for the purposes of protection, ventilation, heat-insulation and drainage, the distance plate comprising a board of pressure-resistant material having a first plurality of parallel evenly-spaced rows of ribs and a second plurality of parallel evenly-spaced rows of ribs perpendicular to said first plurality to form a lattice extending from a planar surface on one side of the board in a pattern with the perpendicular ribs forming intersections, frusto-pyramid projections extending from said one side of the board at all the intersections of the pattern, and substantially rectangular domes intermediate surrounding ribs with flattened outer surfaces extending outwardly from the planar surface on the other side of the board and covering a significantly larger surface area of the board than the projections, said frusto-pyramid projections forming spacers with flattened truncated ends for resting against a wall of a building and securing the board to the wall, said domes forming cavities held by the spacers away from the wall for ventilation and water flow between the wall and the board.

2. The building component according to claim 1, wherein the projections project further from the planar surface than the domes.

3. A building component according to claim 1, wherein said building component consists of a sheet of plastic material which is resistant to rotting and ageing.

4. A building component according to claim 3 having board attachment means comprising flat plates which fit within the frusto-pyramid projections and forming holes therethrough for receiving attachment nails or screws.

* * * * *